US006341560B1

(12) United States Patent
Shah et al.

(10) Patent No.: US 6,341,560 B1
(45) **Date of Patent: *Jan. 29, 2002**

(54) IMAGING AND PRINTING METHODS USING CLAY-CONTAINING FLUID RECEIVING ELEMENT

(75) Inventors: Ajay Shah, Livingston, NJ (US); Charles D. DeBoer, Palmyra, NY (US)

(73) Assignee: Kodak Polychrome Graphics LLC, Norwalk, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/243,983

(22) Filed: Feb. 4, 1999

(51) Int. Cl.[7] ..... B41C 1/10
(52) U.S. Cl. ..... 101/463.1; 101/455; 101/457
(58) Field of Search ..... 101/455, 457, 101/461, 462, 463.1, 465–467

(56) References Cited

U.S. PATENT DOCUMENTS

| | | | | |
|---|---|---|---|---|
| 3,922,441 A | * | 11/1975 | Shaw | 101/455 |
| 4,338,133 A | | 7/1982 | Toyoda et al. | 106/31.58 |
| 5,270,078 A | * | 12/1993 | Walker et al. | 427/264 |
| 5,582,106 A | * | 12/1996 | Kanda et al. | 101/462 |
| 5,609,914 A | * | 3/1997 | Ma et al. | 427/264 |
| 5,695,908 A | * | 12/1997 | Furukawa | 101/466 |
| 5,714,250 A | * | 2/1998 | Kato et al. | 101/458 |
| 5,738,013 A | * | 4/1998 | Kellett | 101/467 |
| 5,820,932 A | * | 10/1998 | Hallman et al. | 101/466 |
| 5,852,975 A | * | 12/1998 | Miyabe et al. | 101/463.1 |
| 5,970,873 A | * | 10/1999 | DeBoer et al. | 101/455 |

FOREIGN PATENT DOCUMENTS

| | | |
|---|---|---|
| EP | 754560 | 1/1997 |
| EP | 0 776 763 A1 | 6/1997 |
| JP | 53-015905 A | 2/1978 |
| JP | 56-105960 A | 8/1981 |
| JP | 62-025081 | 2/1987 |

* cited by examiner

*Primary Examiner*—Stephen R. Funk
(74) *Attorney, Agent, or Firm*—Baker Botts L.L.P.

(57) ABSTRACT

A lithographic imaging member is prepared by applying an ink jetable fluid to a fluid-receiving element that includes a clay-containing fluid-receiving surface layer. This layer also includes a water-soluble binder and a silane hardening agent. The applied fluid is an aqueous solution of a silane having multiple hydroxy, alkoxy or acetoxy groups that is readily absorbed in the clay-containing surface, and dried to provide an oleophilic image.

18 Claims, 1 Drawing Sheet

IMAGING AND PRINTING METHODS USING CLAY-CONTAINING FLUID RECEIVING ELEMENT

FIELD OF THE INVENTION

This invention relates to imaging members and their preparation by imagewise application of a fluid to a clay-containing fluid receiving element. The invention also relates to a method of using the imaging members for lithdgraphic printing.

BACKGROUND OF THE INVENTION

The art of lithographic printing is based upon the immiscibility of oil and water, wherein the oily material (or ink) is preferentially retained by image areas on a substrate. When a suitably prepared surface is moistened with water and ink is applied, certain areas retain the water and repel the ink, and other areas accept the ink and repel the water. Ink can then be transferred to the surface of a suitable receiving material, such as cloth, paper or metal, thereby reproducing the image. Commonly, the ink is transferred to an intermediate material known as a blanket that in turn imagewise transfers the ink to the surface of the receiving material upon which the image is to be reproduced.

Conventional lithographic printing plates typically include a hardenable polymeric layer (usually visible or UV light-sensitive) on a suitable metallic or polymeric support. Both positive- and negative-working printing plates can be prepared in this fashion. Upon exposure, and perhaps post-exposure heating, either imaged or non-imaged areas are removed using wet processing chemistries.

Thermally sensitive printing plates are also known. They include an imaging layer comprising a mixture of dissolvable polymers and an infrared radiation absorbing compound. While these plates can be imaged using lasers and digital information, they require wet processing using alkaline developers to provide the printable image.

Many different types of digitally controlled imaging or printing systems are known. These systems utilize a variety of actuation mechanisms, marking materials and recording media. Examples of such systems include, but are not limited to, laser electrophotographic printers, LED electrophotographic printers, dot matrix impact printers, thermal paper printers, film recorders, thermal wax printers, dye diffusion thermal transfer printers, and ink jet printers. Due to various disadvantages or limitations, such digital printing systems have not significantly replaced mechanical printing presses and the more conventional printing plates described above, even though these older systems are labor intensive and inexpensive only when more than a few thousand copies of the same image are wanted. Yet, there is considerable activity in the industry to prepare media that can be digitally imaged and used to provide high quality, inexpensive copies in either a short or long printing job.

Ink jet printing has become recognized as a viable alternative in the industry because of its non-impact deposition of ink droplets, low-noise characteristics, its use of common receiving materials, and its avoidance of toner transfer and fixing (as in electrophotography). Ink jet printing mechanisms can be characterized as either continuous ink jet or "drop on demand" ink jet printing. Various ink jet printers and systems are currently available for a number of markets, including their common use with personal computers. A very essential aspect of such systems, of course, is a printing ink that has all of the necessary properties for a given application.

The use of ink jet technology to provide lithographic printing plates has been shown in the trade on a number of occasions, including the Print '97 trade show in Chicago, September, 1997 (for example by Iris Graphics, Inc.). Various early publications about such technology including nozzles and drop modulation include U.S. Pat. No. 1,941,001 (Hamsell), U.S. Pat. No. 3,373,437 (Sweet et al), U.S. Pat. No. 3,416,153 (Hertz et al), U.S. Pat. No. 3,878,519 (Eaton), and U.S. Pat. No. 4,346,387 (Hertz).

Printing plates made using ink jet printing are also described in U.S. Pat. No. 4,003,312 (Gunther), U.S. Pat. No. 4,833,486 (Zerillo), U.S. Pat. No. 5,501,150 (Leenders et al), U.S. Pat. No. 4,303,924 (Young), U.S. Pat. No. 5,511,477 (Adler et al), U.S. Pat. No. 4,599,627 (Vollert), U.S. Pat. No. 5,466,658 (Harrison et al), and U.S. Pat. No. 5,495,803 (Gerber et al).

JP Kokai 53-015905 describes the preparation of a printing plate by ink jet printing using ink comprising an alcohol-soluble resin in an organic solvent onto an aluminum support. Similarly, JP Kokai 56-105960 describes ink jet printing using an ink comprising a hardening substance, such as an epoxy-soybean oil, and benzoyl peroxide, or a photohardenable polyester, onto a metallic support. These inks are disadvantageous in that they include light-sensitive materials or environmentally unsuitable organic solvents. EP-A-0 776,763 (Hallman et al) describes ink jet printing of two reactive inks that combine to form a polymeric resin on a printing plate. JP Kokai 62-25081 describes the use of oleophilic ink jet ink.

Inks for high-speed ink jet drop printers must have a number of special characteristics. Typically, water-based inks have been used because of their conductivity and viscosity range. Thus, for use in a jet drop printer the ink must be electrically conductive, having a resistivity below about 5000 ohm-cm and preferably below about 500 ohm-cm. For good fluidity through small orifices, the water-based inks generally have a viscosity of from 1 to 15 centipose at 25° C.

In addition, in recent years, the drop size of inks applied by ink jet printing has become smaller resulting in higher resolution and quality images, but the smaller drop size requires smaller nozzles for application. These smaller nozzles are more likely to become partially or wholly plugged from dried ink and deposits, thereby affecting the size and accuracy of drop placement.

Beyond this, the inks must be stable over a long period of time, compatible with ink jet materials, free of microorganisms and functional after printing. Required functional characteristics include resistance to smearing after printing, fast drying on paper, and being waterproof when dried.

While the teaching of the art provides some solutions to these problems, there is a continuing need for an improved means for preparing imaging members (such as lithographic printing plates) using ink jet printing in order to provide accurate and high quality images.

SUMMARY OF THE INVENTION

This invention provides an imaging method comprising:

A) imagewise applying a fluid to a fluid receiving layer of a fluid receiving element, the fluid receiving layer comprising clay, a water-soluble binder and a hardening agent, the fluid comprising an aqueous solution of a silane having two or more hydroxy, alkoxy or acetoxy groups.

Thus, this invention also includes an imaging member provided by the imaging method described above.

In additional embodiments of the invention, the noted method further includes the steps of:

B) contacting the image on the fluid receiving element with water or a fountain solution and ink, and C) imagewise transferring the ink to a receiving material.

One advantage of this invention is that a durable imaging member can be prepared quickly and effectively using ink jet printing without the necessity of heating or additional treatment (although such heating and treatment can be used if desired). The resulting printing members can be used to provide images with good discrimination and high quality. The fluid used in the method has low viscosity and thus minimizes the possibility of plugging of ink jet printing heads. Moreover, the fluid is rapidly dried or cured to form a water-insoluble matrix in the fluid receiving layer that is partially composed of clay. This layer quickly absorbs the fluid so there is little fluid spreading that would reduce image discrimination.

It was surprising that the specific fluid used in the present invention could be used in combination with the specific fluid receiving element described herein to provide an imaging member that provides highly accurate and high quality printed images.

DETAILED DESCRIPTION OF THE INVENTION

The following description of this invention is directed to the use of particular embodiments of ink jet inks, fluid-receiving elements, imaging members and methods of their preparation and use. It is to be understood that embodiments not specifically described, but which would be variations obvious to one skilled in the art, are also included within the present invention.

Figure 1:
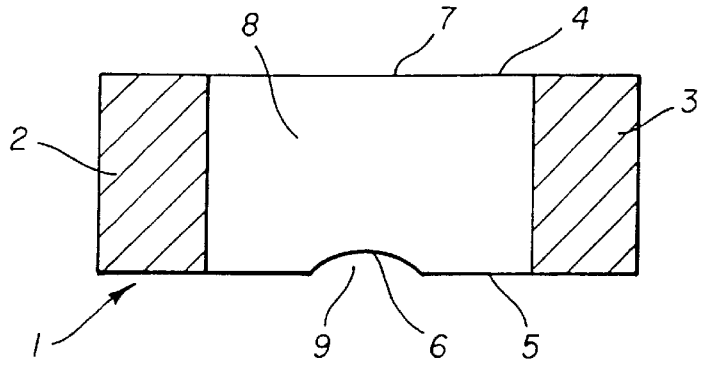
FIG. 1 is a cross-sectional schematic view of a conventional piezoelectric fluid printing head.

Considering FIG. 1, a representative printing head 1 has outlet plate 5 that includes one or more outlet orifices for forming one or more fluid droplets (usually multiple droplets). One of such outlet orifices is outlet orifice 9 shown as having a suitable outlet diameter. Outlet plate 5 is suitably attached to piezo walls 2 and 3, and fluid to be discharged is retained in pumping cavity 8. Inlet orifice 7 located in inlet plate 4 allows for the fluid to be introduced into pumping cavity 8. A fluid droplet meniscus 6 is formed in outlet orifice 9. While FIG. 1 shows a representative printing head, a variety of printing heads are known in the art and available from a number of commercial sources, including Epson, Hewlett Packard and Cannon.

Figure 2:
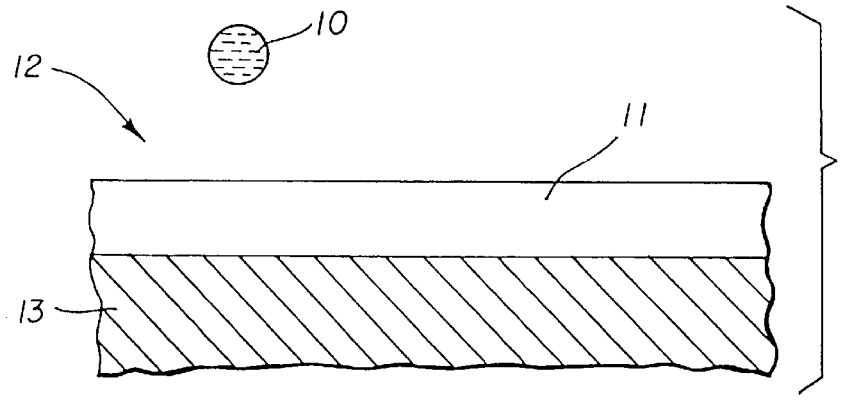
FIG. 2 is a partial cross-sectional view of a representative fluid-receiving element useful in the practice of this invention to which an ink jet fluid droplet is being applied.
Figure 3:
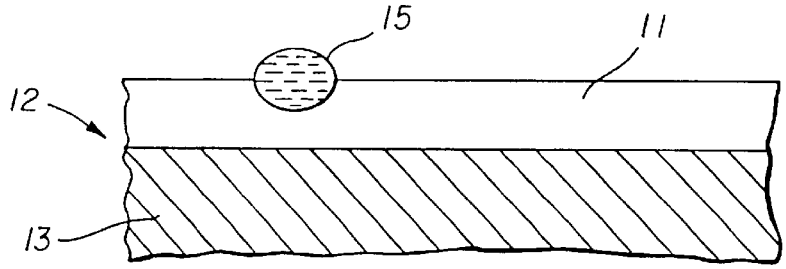
FIG. 3 is a partial cross-sectional view of the fluid-receiving element of FIG. 2, after application of the ink jet fluid droplet that is dried to the clay-containing fluid receiving layer to form an imaging member of this invention.

FIG. 2 shows fluid receiving element 12 comprising support 13 having disposed thereon clay-containing fluid receiving layer 11. Droplet 10 of an ink jet fluid is being imagewise applied to the surface of fluid-receiving layer 11 which may optionally be provided with an outermost hydrophilic protective overcoat layer 17. In FIG. 3, fluid receiving element 12 is shown again, but now as an imaging member. Deposited ink jet fluid droplet 15 is shown as having at least partially penetrated fluid receiving layer 11 that is porous to form an imaging surface of an imaging member that can be used in lithographic printing.

Figure 4:
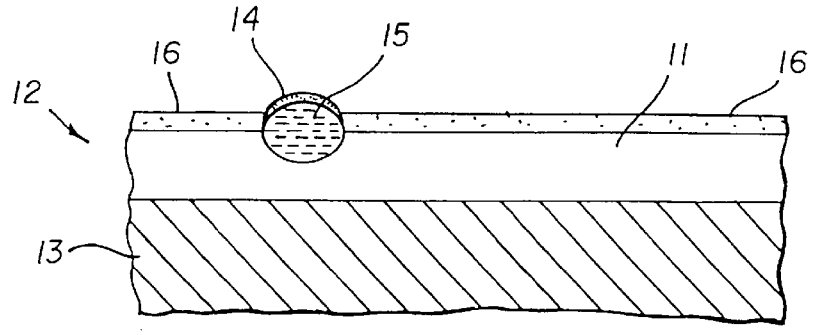
FIG. 4 is a partial cross-sectional view of the fluid-receiving element of FIG. 3 after application of a lithographic printing ink and fountain solution.

Lastly, in FIG. 4, imaging member 12 is shown after application of lithographic printing ink 14 that is attracted to deposited ink jet fluid droplet 15. Background areas 16 of fluid receiving layer 11 accept water or a fountain solution instead of ink.

The supports of the fluid receiving elements useful in the present invention are generally hydrophilic (that is, abhesive to lithographic printing inks, and receptive to water). Such supports can be composed of metal, paper or polymer (such as polyesters or polyimides) sheets, foils or laminates thereof, as long as they have the requisite properties. Metal supports (such as aluminum, zinc or steel) are preferred for their dimensional stability. A particularly useful support is cleaned or degreased aluminum. The metal surface may or may not be treated or roughened (using physical or chemical roughening to produce surface hydroxy groups) for improved hydrophilicity. Such supports will effectively repel lithographic printing inks and "hold" or accept water (or an aqueous fountain solution).

Polymeric supports can also be used for monochrome or spot color printing jobs where the positional variations or lack of dimensional stability is not important. The polymeric supports may be treated or provided with a hydrophilic surface. For example, a hydrophobic polyethylene terephthalate or polyethylene naphthalate film can be coated with a hydrophilic subbing layer composed of, for example, a dispersion of titanium dioxide particles in crosslinked gelatin to provide a roughened surface, or any of the conventional "subbing" materials (such as vinylidene chloride polymers) used to prepare photographic films in the photographic art. Paper supports can be similarly treated and used in the practice of this invention.

Supports can have any desired thickness that would be useful for a given application, and to sustain the wear of a printing press and thin enough to wrap around a printing form, for example from about 100 to about 500 $\mu$m in thickness. A preferred support composed of polyethylene terephthalate can have a thickness of from about 100 to about 200 $\mu$m.

The fluid receiving layer in the fluid receiving element has a composition that enables it to receive (or possibly absorb or dissolve) the applied fluid. The applied fluid preferably exhibits a contact angle of at least 20°, and more preferably at least 30°. Contact angle (static) can be readily measured using a commercially available Rame-Hart Contact Angle goniometer. The contact angle is measured after 30 seconds after application of a fluid droplet to a dried surface layer prepared out of a 5% (by weight) solution of the desired fluid receiving layer material that has been spun coated onto a glass support at 2000 rpm.

The fluid receiving layer rapidly absorbs the applied fluid so that the fluid dries without appreciable spreading. The fluid receiving layer is therefore composed of a number of essential components that include clay, one or more water-soluble binders, and one or more hardening agents. In preferred embodiments, this layer also includes one or more colloidal silicas.

Useful clays may be either synthetic or naturally occurring materials. They include, but are not limited to, kaolin (aluminum silicate hydroxide) which is to be understood to include the minerals kalinite, dickite, nacrite and halloysite-endellite. Other useful clays include, but are not limited to, the serpentine clays (including the minerals chrysotile, amersite, cronstedite, chamosite and garnierite), the montmorillonites (including the minerals beidellite, nontronite, hextorite, saponite and sauconite), the illite clays, glauconite, chlorites, vermiculites, bauxites, attapulgites, sepiolites, palygorskites, corrensites, allophanes, imogolites, diaspores, boehmites, gibbsites, cliachites and mixtures thereof. In addition, synthetic clays such as laponite and hydrotalcite (a chemical composition comprising magnesium aluminum hydroxy carbonate hydrate) may be used. Kaolin is preferred. Mixtures of these clays can also be used if desired. They can be obtained from a number of commercial sources including for example, ECC International and Southern Clay Products.

When colloidal silica is present, it can be obtained from a number of commercial sources, for example as LUDOX SM-30 from DuPont, and as Nalco 2326 from Nalco Corporation.

One or more useful water-soluble binders include both inorganic and organic binder materials such as, but not limited to, gelatin (and gelatin derivatives known in the photographic art), water-soluble cellulosic materials (for example hydroxypropylcellulose, hydroxyethylcellulose, hydroxypropylmethylcellulose and carboxymethylcellulose), water-soluble synthetic or naturally occurring polymers [for example polyvinyl alcohol, poly(vinylpyrrolidones), polyacrylamides, water-absorbent starches, dextrin, amylogen, and copolymers derived from vinyl alcohol, acrylamides, vinyl pyrrolidones and other water-soluble monomers], gum arabic, agar, algin, carrageenan, fucoidan, laminaran, corn hull gum, gum ghatti, karaya gum, locust bean gum, pectin, guar gum and other water-soluble film-forming materials that would be readily apparent to one skilled in the art. The cellulosic materials are preferred. Mixtures of any of these materials can be used also for this purpose. By "water-soluble" is meant that the material can form a greater than 1% solution in water. Such water-soluble binder materials can be readily prepared from known starting materials using conventional starting materials, or obtained from a number of commercial sources, including Eastman Chemical Company (for cellulosic materials), Dow Chemical Company and Aldrich Chemical Company.

Another essential component of the fluid receiving layer is one or more hardening agents. The complete function of these materials is uncertain, but when they are omitted, the clay-containing layer is less cohesive and adhesive, and has less wearability. Useful hardening agents include, but are not limited to, tetraalkoxysilanes (such as tetraethoxysiliane and tetramethoxysilane) and silanes having at least two hydroxy, alkoxy or acetoxy groups [including but not limited to 3-aminopropyltrihydroxysilane, glycidoxypropyltriethoxysilane, 3-aminopropylmethyldihydroxysilane, 3-(2-aminoethyl) aminopropyltrihydroxy silane, N-trihydroxysilylpropyl-N, N,N-trimethylammoniumchloride, trihydroxysilylpropanesulfonic acid and salts thereof]. The first two compounds in this list are preferred. These materials can be readily obtained from several commercial sources including Aldrich Chemical Company.

An optional but preferred material is a coating surfactant, such as CT-121 (Air Products Corporation), ZONYL™ FSN nonionic surfactant (DuPont), Olin 10G (Olin Corporation) and FLUORAD™ FC 431 nonionie surfactant (3M Company). The fluorosurfactants are preferred, and ZONYL™ FSN nonionic surfactant is most preferred.

Still other optional component of the fluid receiving layer is one or more metal oxides of silicon, beryllium, magnesium, aluminum, germanium, arsenic, indium, tin, antimony, tellurium, lead, bismuth or transition metals. For purposes of this application, silicon is considered a "metal". Silicon oxide, aluminum oxide, titanium oxide and zirconium oxide compounds are preferred, and silicon oxide and titanium oxide compounds are most preferred, in the practice of this invention. Mixtures of oxides can also be used in any combination and proportions.

Additional materials useful in the fluid receiving layer include amorphous silica particles (for example, about 5 $\mu$m in average size) to provide a roughness of the surface that is eventually used for printing, fillers (such as ground limestone, talc, calcium sulfate, barium sulfate, titanium dioxide, zinc oxide, zinc sulfide, zinc carbonate, titanium white, aluminum silicate, diatomaceous earth, calcium silicate, magnesium silicate, aluminum hydroxide, alumina and lithopone), pigments (such as styrene-based plastic pigments, acrylic-based plastic pigments, microcapsules and urea resin pigments), pigment dispersants, thickeners, blowing agents, penetrants, dyes or colored pigments, optical brighteners, ultraviolent radiation absorbers, antioxidants, preservatives and antifungal agents.

The amounts of the essential components, and some optional but preferred components of the fluid receiving layer as shown in TABLE I below. The amounts are for dry coating weight percentages, and all ranges are considered approximate at each range end point (that is "about").

TABLE I

| COMPONENT | GENERAL AMOUNT | PREFERRED AMOUNT |
|---|---|---|
| Clay | 30–80% | 50–70% |
| Colloidal silica | 15–50% | 20–40% |
| Water-soluble polymer binder | 2–15% | 5–12% |
| Hardening agent | 1–10% | 1–5% |
| Surfactant | 0.01–1% | 0.1–0.5% |
| Amorphous silica | 0.1–10% | 1–3% |

In most preferred embodiments, the fluid receiving layer is composed of about 62% of clay, about 29% of colloidal silica, about 8% of a cellulosic binder, and about 4% of a hardening agent, all percentages being based on total layer dry weight. The remainder of the layer can be composed of the various addenda described herein.

The materials in the fluid receiving layer can be applied to the support in any suitable manner using conventional coating equipment and procedures. Upon drying, the fluid receiving layer is generally at least 0.1 $\mu$m in thickness and can be as thick as 30 $\mu$m.

While the fluid receiving layer can be the outermost layer of the fluid receiving element, it is also possible for the element to have an outermost hydrophilic "overcoat" or protective overcoat layer over the fluid receiving layer. This outermost layer can be designed for a number of purposes, one purpose being protection against fingerprints on the resulting image. The protective overcoat layer is generally composed of one or more film-forming, water-soluble materials such as those described above as binders for the fluid-receiving layer. Thus, the protective layer rapidly absorbs, or dissolves within, an applied fluid so that upon drying, the area to which the fluid has been applied becomes firmly attached to the underlying clay-containing fluid-receiving layer. The water-soluble cellulosic materials described as binders are most preferred in such protective overcoat layers. Some of the water-soluble materials are designed to exhibit a contact angle of at least 20° upon contact with the applied fluid so as to reduce the spread of the applied fluid. Other useful water-soluble materials may have a contact angle below 20°.

The applied fluid used to make the imaging members is preferably an aqueous solution or dispersion of one or more specific materials that can be absorbed into the fluid receiving layer, and can be dried or cured to form an insoluble matrix within that layer. Other solvents can be used as long as they are readily removed after fluid application and do not adversely affect the fluid receiving layer.

In these embodiments, the fluid can comprise water and one or more water-miscible polar organic solvents such as alcohols (for example, as ethanol, isopropanol, methanol and n-propanol), polyhydric alcohols (such as ethylene glycol, diethylene glycol, triethylene glycol and trimethylol propane), N-methylpyrrolidone and butyrolactone. Water and water/alcohol mixtures are preferred.

The fluid critically contains one or more silanes having two or more hydroxy, alkoxy or acetoxy groups that form stable solutions in water. Representative silanes include, but are not limited to, 3-aminopropyltrihydroxysilane, 3-aminopropyl-methyldihydroxysilane, 3-(2-aminoethyl) aminopropyltrihydroxysilane, N-trihydroxysilylpropyl-N,N, N-trimethylammoniumchloride, trihydroxysilylpropane-sulfonic acid and salts thereof, and reaction products of 3-aminopropyltrihydroxysilane and various epoxides, such as glycidol, as well as reaction products of 3-glycidoxypropyltrihydroxysilane and various amines, such as benzylamine. The 3-aminopropyltrihdyroxysilane and 3-aminopropyldihydroxy-silane are more preferred, and a mixture of these two compounds is most preferred. Such a mixture can include about 6% (based on total fluid weight) of the first compound, and about 3.5% of the second compound. The compounds can be added to water, and the solution held for several hours at room temperature to complete the hydrolysis. Heating will speed up this reaction.

Generally, the amount of the one or more noted silanes in the fluid is at least 1 weight %, preferably at least 5 weight %, and more preferably at least 15 weight %. The silane can be present in an amount up to 50 weight %, preferably up to 25 weight %, and more preferably up to 20 weight %.

It will also be understood by one skilled in the art that an aqueous solution of silanes having two or more hydroxy, alkoxy or acetoxy groups will be in rapid and continuous equilibrium with condensed structures wherein water is eliminated between two hydroxysilane molecules giving silicon-oxygen-silicon structures. Since the equilibrium condensation reactions are reversible, there will always be some of the monomeric silane present, along with condensed species. The exact ratio of the different condensed species to the monomeric species will depend upon the total concentration of silane in the solution, the amount of other solvents present (if any), and solution temperature.

The fluids used in this invention can also include other addenda, including organic anionic or nonionic surfactants to provide the desired surface tension (for example, those described in U.S. Pat. No. 4,156,616, U.S. Pat. No. 5,324, 349 and U.S. Pat. No. 5,279,654), humectants or co-solvents (such as ethylene glycol and sorbitol) to keep the fluid from drying out or clogging the orifices of ink jet print heads, penetrants to help the fluid penetrate the surface of the support. A biocide, such as PROXEL™ GXL biocide (Zeneca Colors), KATHON™ XL biocide (Rohm and Haas), triclosan (Ciba Specialty Chemicals) may also be included to prevent microbial growth. Other addenda may be thickeners or viscosity builders (such as polyethylene glycol), surfactants (such as ZONYL FSN from DuPont), wetting agents, pH adjusters, buffers, conductivity enhancing agents, drying agents and defoamers. The amounts of such materials in the fluids would be readily apparent to one skilled in the art. Generally, the fluids are colorless, but they may also contain soluble or dispersed colorants.

The surface tension of the fluid is generally at least 20 and preferably at least 30 dynes/cm, and generally up to 60 and preferably up to 50 dynes/cm. Surface tension can be measured in a conventional manner, for example, using a commercially available du Nony Tensiometer (Scientific Products, McGaw Park, Ill.). Fluid viscosity can be generally no greater than 20 centipoise, and preferably from about 1 to about 10, and more preferably from about 1 to about 5, centipoise. Viscosity is measured in a conventional manner, for example, using a commercially available Brookfield Viscometer.

The fluids described herein can be applied to the fluid receiving layer in any suitable manner that provides droplets to its surface in an imagewise fashion. Preferably, they are applied using ink jet printing techniques and devices.

Thus, the fluid can be applied using ink jet printing in a controlled, imagewise fashion to the surface of the fluid-receiving layer by ejecting droplets from a plurality of nozzles or orifices in a print head of an ink jet printer (such as a piezoelectric ink jet printing head). Commercially ink jet printers use various schemes to control the deposition of the droplets. Such schemes are generally of two types: continuous stream and drop-on-demand.

In drop-on-demand systems, the fluid droplets are ejected from orifices directly to a position on the support by pressure created by, for example, a piezoelectric device, an acoustic device, or a resistive heater controlled in accordance with digital signals. Thus, fluid droplets are not generated and ejected through the orifices of the print head unless they are needed to print pixels. Commercially available ink jet printers using such techniques are well known and need not be described in detail here.

Continuous ink jet printers have smaller drops and can be used, but the fluids must be conductive because the fluid droplets are deflected between the receiving material and a collection gutter by electrostatic deflectors.

The fluids described herein can have properties compatible with a wide range of ejecting conditions, for example, driving voltages and pulse widths for thermal ink jet printers, driving frequencies of the piezoelectric element for either a drop-on-demand device or a continuous device, and the shape and size of the nozzles.

Once the fluid has been applied to the fluid receiving layer, the solvent is removed in any suitable fashion, such as drying, wicking, evaporation, sublimation or combinations thereof. Drying can be accomplished using any suitable source of energy that will evaporate the liquid without harming the water-insoluble matrix that is formed in the fluid receiving layer. Preferably, the imaging member is dried to form the durable, water-insoluble, inorganic polymeric matrix described above. Drying means and conditions can vary depending upon the viscosity of the fluid, the solvent used, and various other features. The applied fluid may be heated to speed up the drying process. Usual drying of the imaging member would be for example at a temperature of at least 100° C. for at least 30 seconds. If the fluid requires curing to cause a desired chemical reaction, curing can be accomplished by ultraviolet radiation, electron beam radiation or gamma radiation.

The resulting imaging member having an imagewise distribution of dried fluid can then be inked with a suitable lithographic printing ink (for example, with a fountain solution). The inked image can then be transferred to a suitable receiving material, such as paper, metal sheets or foils, ceramics, fabrics and other materials known in the art. The image can be transferred directly to the receiving materials, or indirectly by transfer first to what is known as a blanket roller, which in turn transfers the ink image to the receiving material.

The imaging members prepared using the present invention can be of any suitable shape or form, including but not limited to, printing plates, printing tapes (or webs), and printing cylinders or drums. Preferably, the imaging member is a printing plate.

The following examples are presented to illustrate, but not limit, the present invention.

EXAMPLE 1

| COMPONENT | AMOUNT |
|---|---|
| Kaolin clay (ECCA-TEX 540 from ECC Int.) | 144 g |
| Deionized water | 240 g |
| Colloidal silica (LUDOX SM-30 from DuPont) | 240 g |
| Hydroxypropylmethylcellulose (5% aqueous, METHOCEL K100LV from Dow Chemical) | 408 g |
| Surfactant CT-121 (Air Products Company) | 12 g |

These components were pre-mixed for 10 minutes using high shear to completely wet and swell the clay. The mixture was then passed through a horizontal sand mill (or Zirconia beads mill) for 10–30 minutes (recirculation) to reduce any clay agglomerates. To the resulting 1000 g mixture was then added 10 ml of tetramethoxy orthosilicate hardening agent followed by thorough mixing. The resulting mixture was coated at 50 ml/m$^2$ onto either a grained aluminum or subbed polyethylene terephthalate support using conventional means and dried in hot air. The dry coatings were then hardened at 100° C. for 30 minutes.

The resulting fluid receiving elements were loaded into an Epson Stylus Color 600 printer having an ink cartridge that had been cleaned and filled with an aqueous solution of 10% (by weight) of 3-aminopropyltriethoxysilane and 5% (by weight) of 3-aminopropylmethyldiethoxysilane.

The silane fluid was imagewise applied to the kaolin-containing fluid receiving layer of the fluid receiving elements and dried. The resulting imaging members were then mounted onto a commercial A. B. Dick printing press and used to print several thousand excellent copies of the test image onto papers. The resulting printed images were sharp and clear and photomicrographs showed a single dot diameter of about 100 $\mu$m. The background areas were white and free from fingerprints.

EXAMPLE 2

Example 1 was repeated except the kaolin was replaced with Bentonite, a montmorillonite clay available from Aldrich Clay Products. The resulting imaging member was used to provide several hundred excellent printed copies of the image applied to the fluid receiving element.

EXAMPLE 3

Example 1 was repeated except the silane fluid was prepared as follows: 5 g of the reaction product of equimolar amounts of 3-aminopropyltriethoxysilane and 1,2-epoxy-3-phenoxypropane was dissolved in a mixture of 65 g of water, 30 g of monobuytlether of diethylene glycol, and 0.45 g of acetic acid. The resulting imaging member provided excellent printed images.

COMPARATIVE EXAMPLE 1

Example 1 was repeated except no kaolin mixture was coated onto the grained anodized aluminum. The resulting imaging member provided blurred images and photomicrographs showed single dot diameters were indistinct, but greater than 500 $\mu$m. The background areas showed severe contamination from fingerprints.

COMPARATIVE EXAMPLE 2

Example 1 was repeated except the silane fluid was replaced with a 5% solution of AQ38 (water dispersible polyester available from Eastman Chemical Company). The resulting imaging member provided printed images of low density that were discontinuous (with many small white areas in the inked portions of the image). In addition, the inkjet print head in the printer containing the fluid became plugged after a few hours of nonuse and would no longer function.

The invention has been described in detail with particular reference to preferred embodiments thereof, but it will be understood that variations and modifications can be effected within the spirit and scope of the invention.

We claim:

1. An imaging method comprising:

A) imagewise applying a fluid to a fluid receiving layer of a fluid receiving element, said fluid receiving layer comprising clay, a water-soluble binder and a hardening agent, said fluid comprising an aqueous solution of a silane having two or more hydroxy, alkoxy or acetoxy groups.

2. The imaging method of claim 1 wherein said fluid receiving layer further comprises colloidal silica.

3. The imaging method of claim 1 wherein said fluid receiving layer further comprises a nonionic surfactant.

4. The imaging method of claim 1 wherein said silane is 3-aminopropyltrihydroxy silane, 3-aminopropylmethyldihydroxy silane, 3-(2-aminoethyl) aminopropyltrihydroxy silane, N-trihydroxysilylpropyl-N, N,N-trimethylammoniumchloride, trihydroxysilylpropanesulfonic acid or a salt thereof, the reaction product of 3-aminopropyltrihydroxysilane and an anhydride, the reaction product of 3-aminopropyltrihydroxysilane and an epoxide, the reaction product of 3-aminopropyltrihydroxysilane and an acid chloride, or the reaction products of 3-glycidoxypropyltrihydroxy silane and an amine, or a mixture of any of these silanes.

5. The imaging method of claim 1 wherein said clay is kaolin, a serpentine clay, a montmorillonite, an illite clay, glauconite, a chlorite, a vermiculite, a bauxite, a attapulgite, a sepiolite, a palygorskite, a corrensite, an allophane, an imogolite, a diaspore, a boehmite, a gibbsite, a cliachite, laponite, hydrotalcite or a mixture of any of these materials.

6. The imaging method of claim 1 wherein said water-soluble binder is a water-soluble polymer that is gelatin or a derivative thereof, a cellulosic material, vinyl pyrrolidone polymer, an acrylamide polymer, polyvinyl alcohol, agar, algin, carrageenan, fucoidan, laminaran, gum arabic, corn hull gum, gum ghatti, guar gum, karaya gum, locust bean gum, pectin, a dextran, a starch or a polypeptide.

7. The imaging method of claim 1 wherein said hardening agent is a silane having two or more hydroxy, alkoxy or acetoxy groups.

8. The imaging method of claim 7 wherein said hardening agent is aminopropyltriethoxysilane or glycidoxypropyltriethoxysilane.

9. The imaging method of claim 8 wherein said image receiving layer further comprises colloidal silica.

10. The imaging method of claim 1 wherein said fluid receiving element further comprises a support.

11. The imaging method of claim 10 wherein said fluid receiving element further comprises a metal, polymeric or paper support.

12. The imaging method of claim 1 wherein said fluid receiving element further comprises a hydrophilic protective overcoat layer.

13. The imaging method of claim 1 wherein said fluid is applied to said fluid receiving element using an ink-jet printing head.

14. The imaging method of claim 1 further comprising:

B) contacting said fluid receiving layer with water or a fountain solution and ink, and C) imagewise transferring said ink to a receiving material.

15. An imaging method comprising:

A) imagewise applying a fluid to a fluid receiving layer of a fluid receiving element, said fluid receiving layer comprising clay, a water-soluble cellulosic binder, a nonionic fluorosurfactant, and aminopropyltriethoxysilane or glycidoxypropyltriethoxysilane as a hardening agent, said fluid comprising an aqueous solution of a 3-aminopropyltrihydroxy silane, 3-aminopropylmethyldihydroxy silane or a mixture of these silanes.

16. The imaging method of claim 15 further comprising:

B) contacting said fluid receiving layer with water or a fountain solution and ink, and C) imagewise transferring said ink to a receiving material.

17. The imaging method of claim 15 wherein said fluid receiving element further comprises an outermost hydrophilic protective overcoat layer.

18. An imaging member prepared by image wise applying a fluid to a fluid receiving layer of a fluid receiving element, said fluid receiving layer comprising clay, a water-soluble binder and a hardening agent, said fluid comprising an aqueous solution of a silane having two or more hydroxy, alkoxy or acetoxy groups.

* * * * *